US006907624B2

(12) United States Patent
Wang et al.

(10) Patent No.: US 6,907,624 B2
(45) Date of Patent: Jun. 21, 2005

(54) BACK SCRUBBER-MASSAGER

(76) Inventors: Rong-Shuang Wang, 609 Shires Way, Egg Harbor Township, NJ (US) 08234; Chung-Shing Wang, 524 Kings Dr., Cherry Hill, NJ (US) 08003

( * ) Notice: Subject to any disclaimer, the term of this patent is extended or adjusted under 35 U.S.C. 154(b) by 0 days.

(21) Appl. No.: 10/652,931

(22) Filed: Sep. 2, 2003

(65) Prior Publication Data

US 2005/0044624 A1 Mar. 3, 2005

(51) Int. Cl.[7] ..... A47K 7/02
(52) U.S. Cl. ..... 4/606; 15/104.92; 601/136
(58) Field of Search ..... 4/606; 15/104.92; 601/136

(56) References Cited

U.S. PATENT DOCUMENTS 1,954,940 A * 4/1934 Mikel ..... 4/575.1
2,836,175 A * 5/1958 Nakayama ..... 601/135
3,478,369 A * 11/1969 Ensley ..... 4/606
4,003,372 A * 1/1977 Willoby ..... 601/28
4,421,110 A * 12/1983 DeLisle et al. ..... 601/134
4,936,294 A * 6/1990 Chu ..... 601/136
5,628,083 A * 5/1997 Hayes ..... 15/244.3

* cited by examiner

*Primary Examiner*—Charles E. Phillips

(57) ABSTRACT

Various simple back scrubber-massagers are invented for the shower/bathtub surround. The scrubber-massagers can be made for permanent installation on an existing shower/bathtub surround or they can be made as a built-in feature of a shower/bathtub surround. Basically, the back scrubber-massagers have either one wall or two parallel walls. Both sides of the footing of a wall are curved for easily cleaning. The top of a wall is smooth and with or without texture. For a two-wall configuration, a protrusion along the upper portion of the inner side of each wall is provided to help holding a sponge or towel between the walls.

2 Claims, 2 Drawing Sheets

B-B Cross Section View

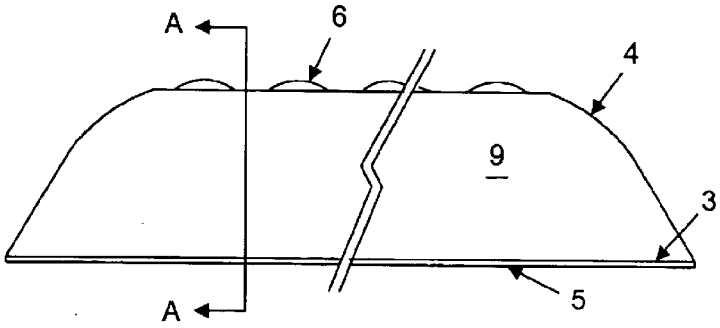
Figure 1 Front View
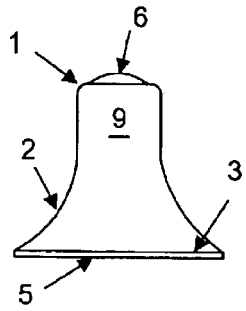
Figure 2 A-A Cross Section View
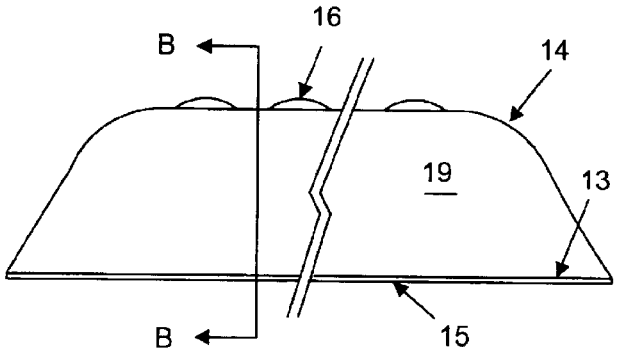
Figure 3 Front View
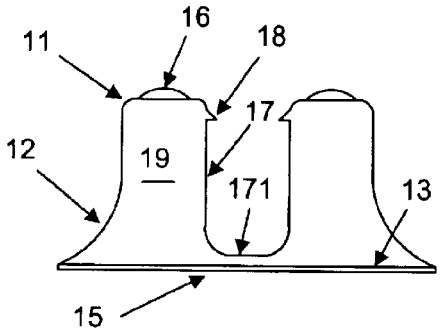
Figure 4 B-B Cross Section View

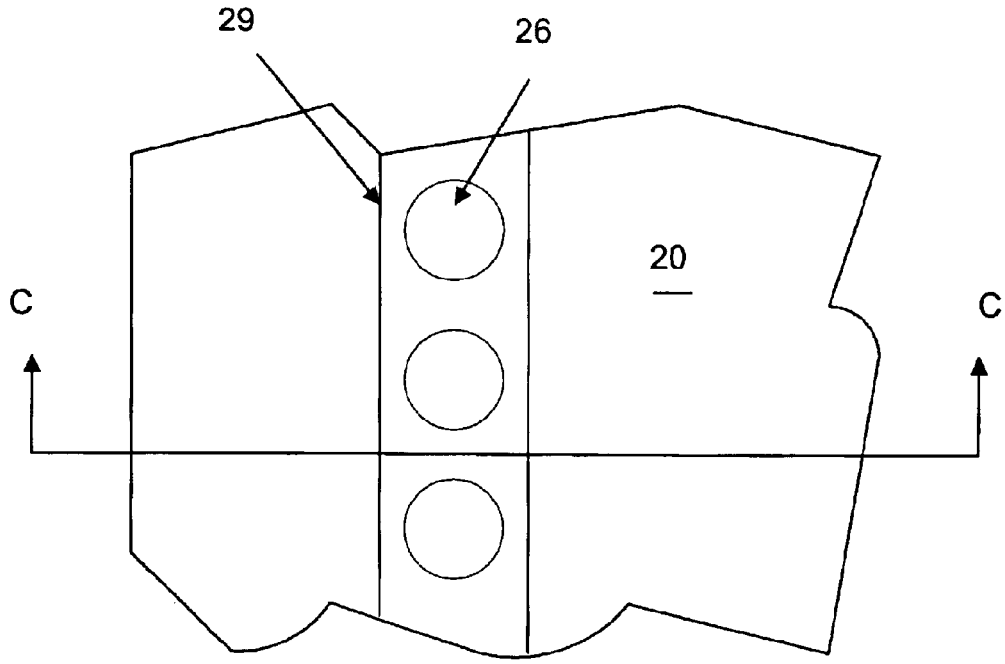
Figure 5 Front View
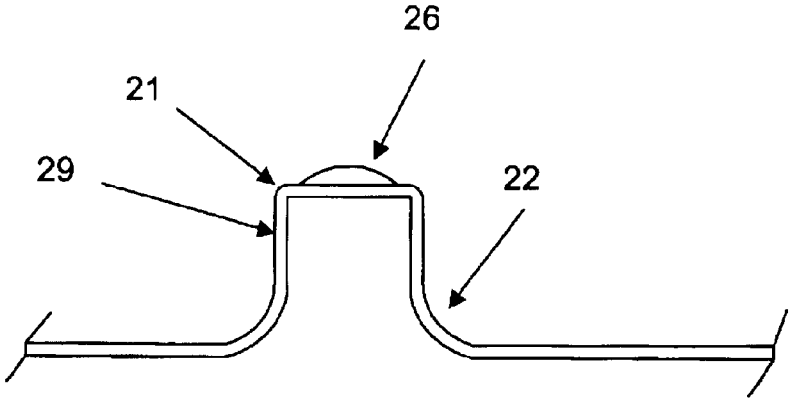
Figure 6 C-C Cross Section View

BACK SCRUBBER-MASSAGER

FIELD OF THE INVENTION

The invention consists of an installable back scrubbing/massaging device for an existing shower/bathtub surround and a shower/bathtub surround having a built-in back scrubbing and massaging mechanism.

BACKGROUND OF THE INVENTION

Many people have difficulties in reaching their backs during bathing. Many back scrubbers and massagers have been invented. Some of them use suction cups for installation on a shower/bathtub surround, and some of them are held by hand during use. All of them need to be cleaned after use, and they are not likely to be shared for use by different persons. Existing shower/bathtub surrounds do not have a built-in scrubbing and massaging feature. A simple and easy to clean built-in or installable back scrubber and massager on the surrounds for effective scrubbing and massaging should be desirable.

OBJECTIVES OF THE INVENTION

One objective of the invention is to provide a permanent back scrubber-massager on a shower/bathtub surround for persons of different heights to use without the need of any adjustment.

Another objective of the invention is to have a scrubber-massager which can provide effective back scrubbing and massaging without using hand.

Yet another objective of the invention is to have a scrubber-massager which can be easily cleaned along with the surround's regular cleaning.

A further objective of the invention is to have a scrubber-massager which can provide scrubbing and massaging function with or without using a sponge or towel.

Yet a further objective of the invention is to have a shower/bathtub surround which has a built-in back scrubbing and massaging feature having the same characteristics as mentioned in the above objectives.

BRIEF DESCRIPTION OF THE DRAWING

FIG. 1 is a front view of a configuration of the invention.

FIG. 2 is the A—A cross section view of the configuration shown in FIG. 1.

FIG. 3 is a front view of another configuration of the invention.

FIG. 4 is the B—B cross section view of the configuration shown in FIG. 3.

FIG. 5 is a front view of a configuration of a built-in scrubber-massager of a shower/bathtub surround.

FIG. 6 is the C—C cross section view of the configuration shown in FIG. 5.

DETAIL DESCRIPTION OF THE INVENTION

The configurations of the scrubber-massagers are described as follows.

FIG. 1 is the front view of a configuration of the scrubber-massagers for a shower/bathtub surround. This configuration has an elongated wall [9]. To suit for persons of different heights between 3 to 6.5 feet, the length of the scrubber-massager is about 4 feet long. Shorter ones can serve users of narrow height ranges. An upper portion [4] of each end of the wall [9] is rounded for comfort and safety reasons. One can apply adhesive on its bottom [3] for installing on a shower/bathtub surround. However, a self-adhesive layer [5] can be attached on the bottom [3] of the scrubber-massager and allows for convenient installation. After the installation, the upper end of the scrubber-massager is at about 6.25 feet and the lower end is at about 2.25 feet from the shower floor or bathtub bottom respectively.

FIG. 2 is the A—A cross section view of the configuration shown in FIG. 1. An edge [1] of the top is rounded for comfort and safety concerns. A width of a middle portion of the wall can be thinner than that of the upper portion. A side [2] of the wall [9] is smoothly curved and an angle between the side and a surface of the bottom [3] is lesser than 90 degrees to allow for easy cleaning after the scrubber-massager is installed on a shower/bathtub surround. When the top is covered by a sponge or towel with soap and the bather's back presses on the sponge or towel, the basically right-angled top edge [1] will prevent the sponge or towel from moving when the back moves sideways back and forth to scrub and massage his/her back. With a scrubber-massager of this configuration, one may have to hold the sponge or towel by hand before his/her back presses on. However, one can simply scrub and massage his/her back directly on this scrubber-massager without using a sponge or towel. The top of the wall [9] can be flat or curved. As an option, textures, like small mounts [6] can be arranged along the top of the wall [9] to enhance scrubbing effect. Other kinds of textures on the top of the wall [9], like one or more longitudinal grooves along the wall [9], can also enhance its scrubbing function. Without using sponge or towel, one may apply soap directly on the top having the longitudinal groove(s), and the soap can fill the groove(s) for the one to scrub his/her back on the top of the wall [9]. For massaging, one can simply press and rub his/her back against the top of the wall [9] with or without a sponge or towel.

FIG. 3 is the side view of another configuration of a scrubber-massager for a shower/bathtub surround. The length of this scrubber-massager is also about four feet or shorter. This configuration has two parallel, elongated walls [19]. An upper portion [14] of each end of each of the walls [19] is rounded for comfort and safety reasons. An optional adhesive layer [15] is attached to a bottom [13] of the walls [19] for convenient installation on the shower/bathtub surround.

FIG. 4 is the B—B cross section view of the configuration shown in FIG. 3. It shows that this configuration has two walls [19]. An edge [11] of a top of each of the walls [19] are rounded for comfort and safety reasons. Like the configuration described in FIGS. 1 and 2, the top surface of each of the walls [19] may be flat or curved and with or without texture. As an option, there is a protrusion [18] along an upper inner side [17] of each of the walls [19]. A width of a middle portion of each of the walls [19] can be thinner than that of the upper portion. A smoothly curved outer side [12], a smoothly curved lower inner side [17] and a bottom [171] of the walls [19] are for easy cleaning purpose. This configuration allows the bather to insert sponge or towel between the two walls [19] thus the sponge or the towel can stay on before he/she presses his/her back on it. The protrusion [18] helps holding the sponge or the towel between the walls [19]. As an option, a texture, like small mounts [16] can be arranged along its top to enhance scrubbing effect. Other kinds of textures on the top of each of the wall [1 9], like one or more longitudinal grooves along the top, can also enhance its scrubbing function. Without using sponge or towel, one may apply soap directly on the top, and the soap will fill the grooves for the one to scrub his/her back on the top.

FIG. 5 is a front view of a configuration of a portion of a shower/bathtub surround [20] having a built-in scrubber/massager. The scrubber-massager of this configuration has one wall [29].

FIG. 6 is the C—C cross-section view of the configuration shown in FIG. 5. Except the side [22] and the portion of surround [20] joint smoothly in one piece in this configuration, the description for the rest of the configuration less the bottom and the adhesive layer in FIGS. 1 and 2 is applicable to this configuration. In FIG. 6, it shows that an outer contour of the wall [29] is the same as that of the wall shown in FIG. 2 but the wall [29] is not solid in this configuration. However, it is obvious that being not solid does not affect the function of a scrubber-massager at all. The configuration of the wall [29] simply reflects a way a surround is manufactured, e.g. by thermo forming. It is not shown here but it is also obvious that, in a similar manner, instead of having a built-in one-wall scrubber-massager described above, a surround can have a built-in two-wall scrubber-massager similar to the one described in FIGS. 3 and 4.

We claim:

1. A back scrubber-massager member for a shower/bathtub surround comprising: a bottom having two parallel elongated upstanding members spaced apart a distance so as to allow the insertion of a towel or sponge between said members, each member having a right wall, a left wall and an end wall at each end of said members and a smooth top wall, the transition from each wall to an adjacent wall being rounded for the comfort and safety of the user, each of the right, left and end walls being smoothly curved such that an angle between them and the bottom being less than 90 degrees for easy cleaning purposes, means on the under surface of the bottom for attaching said member to a shower wall and a protrusion on each of the member walls that face each other for aiding in holding a towel or sponge between said members.

2. A back scrubber-massager for shower/bathtub surround according to claim 1 wherein the top of each of the two walls has a texture on it.

* * * * *